US012584358B1

(12) United States Patent
Marica et al.

(10) Patent No.: US 12,584,358 B1
(45) Date of Patent: Mar. 24, 2026

(54) SUPPORT DEVICE FOR HYDRAULIC WORKOVER UNIT FOR WELLBORE

(71) Applicant: Halliburton Energy Services, Inc., Houston, TX (US)

(72) Inventors: Adrian Marica, Cypress, TX (US); Michael Oser, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/085,821

(22) Filed: Mar. 20, 2025

(51) Int. Cl.
*E21B 15/04* (2006.01)

(52) U.S. Cl.
CPC ..... *E21B 15/045* (2013.01)

(58) Field of Classification Search
CPC ..... E21B 15/00; E21B 15/045
See application file for complete search history.

(56) References Cited

U.S. PATENT DOCUMENTS 3,434,295 A * 3/1969 Manning ..... E21B 41/04 405/170
3,960,360 A * 6/1976 Elliston ..... E21B 19/084 173/147
3,985,189 A * 10/1976 Jahnke ..... E21B 19/146 175/85
4,290,495 A * 9/1981 Elliston ..... E21B 19/084 173/147
6,412,560 B1 * 7/2002 Bernat ..... E21B 19/07 166/383
8,640,767 B2 * 2/2014 Tucken ..... E21B 19/08 175/203
2004/0262015 A1 12/2004 Mazzella et al.
2010/0224357 A1 * 9/2010 Rodgers ..... E21B 33/068 166/77.4
2014/0138095 A1 5/2014 Vergne et al.
2014/0140791 A1 * 5/2014 Yorga ..... E21B 7/02 414/22.52
2014/0186125 A1 7/2014 Andresen et al.
2019/0345014 A1 11/2019 White et al.
2021/0301603 A1 9/2021 Pilgrim
2021/0348456 A1 * 11/2021 Richard ..... E21B 19/22

OTHER PUBLICATIONS

International Patent Application No. PCT/US2025/024840, International Search Report and Written Opinion Dec. 11, 2025, 10 pages.

* cited by examiner

*Primary Examiner* — Shane Bomar
(74) *Attorney, Agent, or Firm* — Kilpatrick Townsend & Stockton LLP

(57) ABSTRACT

A system can include a subsystem and a support device for facilitating torque application of the subsystem during operation. The subsystem can include a hydraulic workover unit that includes hydraulic cylinders. The subsystem can be positioned on a well for facilitating an operation in a wellbore of the well. The support device can be coupled with the subsystem. The support device can include a jaw coupled with the hydraulic cylinder, and the jaw can be arranged with respect to the hydraulic cylinders to facilitate automatic alignment and automatic adjustment of the hydraulic cylinders.

20 Claims, 8 Drawing Sheets

SUPPORT DEVICE FOR HYDRAULIC WORKOVER UNIT FOR WELLBORE

TECHNICAL FIELD

The present disclosure relates generally to wellbore operations and, more particularly (although not necessarily exclusively), to a self-aligning and self-adjusting support device for a hydraulic workover unit that can be positioned in a well system to facilitate a wellbore operation.

BACKGROUND

Wellbore operations may include various equipment, components, methods, or techniques to perform various tasks, such as positioning components, with respect to a wellbore. In some examples, the wellbore operations may involve rotating a downhole tool or system. Rotating the downhole tool or system may involve applying large amounts of torque to the downhole tool or system. Exceeding threshold amounts of torque may deform, damage, or destroy the downhole tool or system. Ensuring that the downhole tool or system does not incur damage or deformation after receiving torque applications can be difficult.

DETAILED DESCRIPTION

Figure 1:
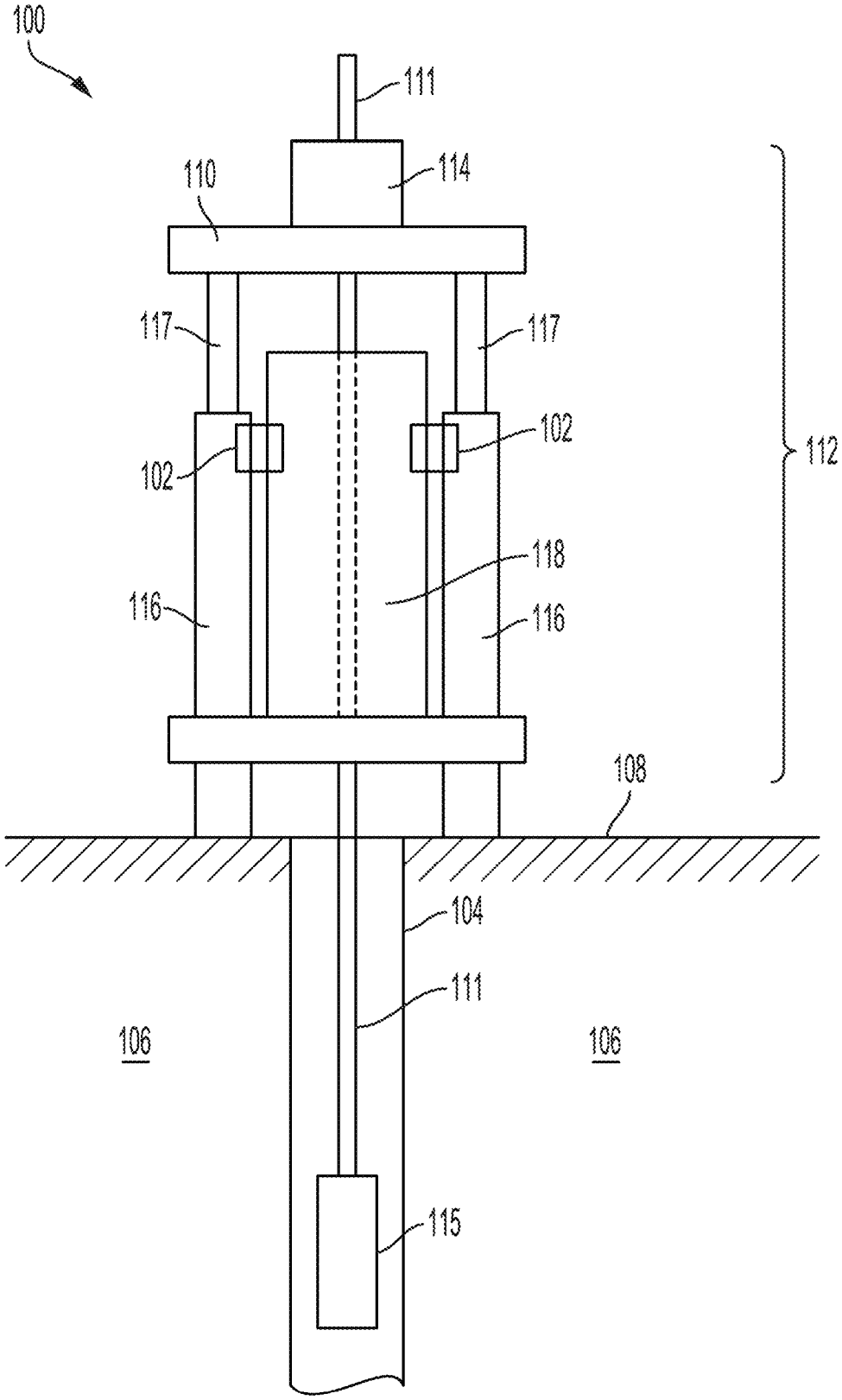
FIG. 1 is a diagram of a well system that can include a support device that can facilitate torque application in a wellbore according to some aspects of the present disclosure.

Certain aspects and examples of the present disclosure relate to a support device for a subsystem that can be positioned in a well system that can include a wellbore. The wellbore can be formed in a subterranean formation or a suboceanic formation for extracting target materials such as hydrocarbon material, water, brine, and the like. In some examples, the wellbore can facilitate injection of target material into the subterranean formation or the suboceanic formation. The subsystem can include any suitable wellbore tool or system that can be positioned in the well system to perform or otherwise facilitate a wellbore operation. In some examples, the subsystem can include a hydraulic workover unit or other suitable unit for the subsystem. The hydraulic workover unit can include a set of hydraulic cylinders that can be secured using the support device. For example, the support device can be applied to each hydraulic cylinder of the set of hydraulic cylinders, or any subset thereof, to provide additional structural support for the hydraulic cylinder. The support device can be self-aligning, self-adjusting, or a combination thereof. For example, the support device can allow the set of hydraulic cylinders to move within a predefined movement range while maintaining structural integrity throughout the subsystem even when receiving torque applications.

In a hydraulic workover unit, hydraulic cylinders may be attached to a base plate using a set of bolts at each cylinder, which may include four bolts. Additionally or alternatively, barrels of the hydraulic workover unit may be connected to an upper plate, such as an upper snubbing plate, by another set of bots, which may include another four bolts. The connections between the cylinders and the base plate, and the connections between the barrels and the upper plate, may not include any additional structural support. For example, there may be no structural features to which the base plate or upper plate are connected, and the cylinders and barrels may, outside of the connections to the respective plates, be free-floating without a structural support. As a wellbore tool that the rods are connected with is translated axially in the wellbore, and as the rods translate within respective barrels or hydraulic cylinders, a traveling plate may move along with the rods. The traveling plate may include or have installed on it a turn table that can facilitate rotation of at least a subset of the hydraulic workover unit in the well system. Torque may be applied to the rods and may be transmitted to the barrels due to physical contact between the rods and guiding bushings inside the barrels.

With no connection to other structures or structural supports, the applied torque may be counteracted by the base bolts securing each barrel or cylinder to the base plate. Consequently, the base bolts may be subjected to very high stress and may potentially fail in other systems that do not include or use a support device. Moreover, being unsecured, a top portion of the barrels or cylinders may exhibit high deflection, bending, other damage or deformation, or a combination thereof in the other systems.

In some examples, a hydraulic jack or a hydraulic workover unit can be used for various workover operations, snubbing operations, other well operations or wellbore operations, or any combination thereof. During the operations, a pipe string associated with the hydraulic workover unit may be rotated such as to perform or otherwise facilitate the operations. Rotating the hydraulic workover unit can involve applying torques of various magnitude so that the string can overcome downhole resistance or other suitable resistance. The torque may be applied by a torque device, such as a turn table, mounted to a traveling plate of the hydraulic workover unit. The mechanical engagement between an output shaft of the torque device and a pipe string associated with the hydraulic workover unit can allow the pipe to be turned while the torque device travels with and along the string in incremental distances, which may be approximately 10 feet (3.05 meters) in length.

In a downstroke motion, the torque device can engage with the pipe and can apply a torque to the pipe to rotate the pipe. In some examples, little-to-no torque may be applied by the torque device during upward motion. During an upward stroke, the pipe may be immobilized by gripping slip bowls of the hydraulic workover unit. Additionally or alternatively, during the upward stroke, the torque device may slide along the pipe without rotation or without applying torque. As the torque device rotates to apply torque to the pipe, and while the rods of the hydraulic workover unit are in a fully stroked position, a large reactive torque is applied to a top of the hydraulic cylinders. Since the hydraulic cylinders are interconnected via an upper snub plate, the torque may be transmitted to the base bolts, which may fail or break. Additionally or alternatively, the base plate may fissure or crack. Both of the above can limit an amount of torque that can be applied to other systems without a support device even if the wellbore operations requests, or in some examples requires, a higher torque value.

A support device, such as the support device disclosed herein, can involve securing at least a subset of the barrels or cylinders of the hydraulic workover unit to a structural feature of the hydraulic workover unit. The structural feature of the hydraulic workover unit may be preexisting and may share some of the stress introduced by the applied torque without risking damage or deformation in the hydraulic workover unit. The support device can disperse counteracting torque throughout the entire structure of the hydraulic workover unit, or any subset thereof. Additionally or alternatively, the support device can allow the hydraulic workover unit to receive a higher torque than other systems with similarly sized units.

The support device can include a jaw that can include a curved surface sized and shaped to make contact with or embrace a corresponding barrel such as a hydraulic cylinder. In some examples, the jaw can include a rotatable component that can contact a hydraulic cylinder or barrel and that can follow a surface of the hydraulic cylinder to retain the hydraulic cylinder within a predefined range-of-motion. The jaw may maintain contact with the corresponding barrel to limit movement of the barrel to a predefined movement range. The contact between the barrel and the jaw may be enabled by a cylindrical joint formed between a concave surface machined on one side of the jaw that matches a convex surface of an attaching plate. The cylindrical joint may be maintained by a set of pivoting bolts. In some examples, the cylindrical joint can allow the jaw to follow the barrel as the barrel deflects and to stay in contact with the barrel regardless of motion or deflection. The plate of the cylindrical joint can be affixed to a fixed plate welded to the support structure, such as a structural column, of the hydraulic workover unit. A connection between the moving plate and the fixed plate can be achieved using a set of perpendicular bolts. The set of perpendicular bolts can push the moving plate against the barrel while the set of pivoting bolts can secure the moving plate to the support structure, or vice versa.

In some examples, the support device can allow the hydraulic cylinders of the hydraulic workover unit to be integrated into the structure of the hydraulic workover unit. Additionally or alternatively, the support device may increase, compared with other systems, a turning or drilling torque capacity of the hydraulic workover unit. Additionally or alternatively, the support device can conform to and support a hydraulic cylinder of the hydraulic workover unit in a self-adjusting and self-aligning manner to compensate for gaps or variations in position between hydraulic cylinders and surrounding structures.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure. As used herein, approximately indicates that a recited value may vary, such as above or below, by 1%, 2%, 3%, 4%, 5%, from 5% to 10%, from 10% to 20%, and the like.

FIG. 1 is a diagram of a well system 100 that can include a support device 102 that can facilitate torque application in a wellbore 104 according to some aspects of the present disclosure. As illustrated in FIG. 1, the well system 100 can include the wellbore 104 formed in a formation 106, which may be or include a subterranean formation, a suboceanic formation, or other suitable formations. At a surface 108 of the wellbore 104, a tripping device 110 may be positioned to allow a string 111 to be lowered into the wellbore 104, to be removed from the wellbore 104, to be repositioned in the wellbore 104, or any combination thereof. In some examples, the string 111 can include or be positioned through a subsystem 112 that can be positioned at the surface 108 of the wellbore 104, or in other suitable locations, to perform or otherwise facilitate one or more wellbore operations. For example, the string 111 can include a wellbore tool 115, such as one or more sensors, a drill bit, etc., that can facilitate a wellbore operation in the wellbore 104. The subsystem 112 can include a hydraulic workover unit that can include the support device 102, though other suitable devices, units, and the like are possible to include in the subsystem 112 to facilitate the one or more wellbore operations.

As illustrated in FIG. 1, the subsystem 112 can include the support device 102, can include a torque device 114, and can include a set of hydraulic cylinders 116, which may be positioned around, or may otherwise be sized to receive, a set of rods 117. The subsystem 112 can include any additional, alternative, or fewer components to provide functionality for the subsystem 112 in the well system 100. In some examples, the torque device 114 can be or include a turn table or other suitable device that can apply, or that can facilitate application of, torque to the string 111, to cause the string 111 to rotate in the wellbore 104. The torque device 114 can apply adjustable levels of torque to the string 111 to overcome downhole resistance or for other suitable purposes. In some examples, the torque applied by the torque device 114 may be transferred to the set of hydraulic cylinders 116 or mechanical affixing means, such as bolts, welds, etc., thereof. The support device 102 can disperse the torque, or any subset thereof, applied to the set of hydraulic cylinders 116.

The support device 102 can include any suitable number of components for facilitating a connection between at least one hydraulic cylinder of the set of hydraulic cylinders 116 and a support feature 118 of the subsystem 112. The support feature 118 may be or include an existing support structure of the subsystem 112. Additionally or alternatively, the support feature 118 may be arranged to receive and disperse large amounts, such as amounts exceeding requirements of the one or more wellbore operations, of torque via the support device 102. The support device 102 may be permanently attached, such as via a weld, to the support feature 118, may be semi-permanently attached, such as via bolts and nuts, to the support feature 118, etc. In some examples, the support device 102 can provide automatic alignment, automatic adjustment, or a combination thereof for at least one hydraulic cylinder of the set of hydraulic cylinders 116 during the one or more wellbore operations.

Figure 2:
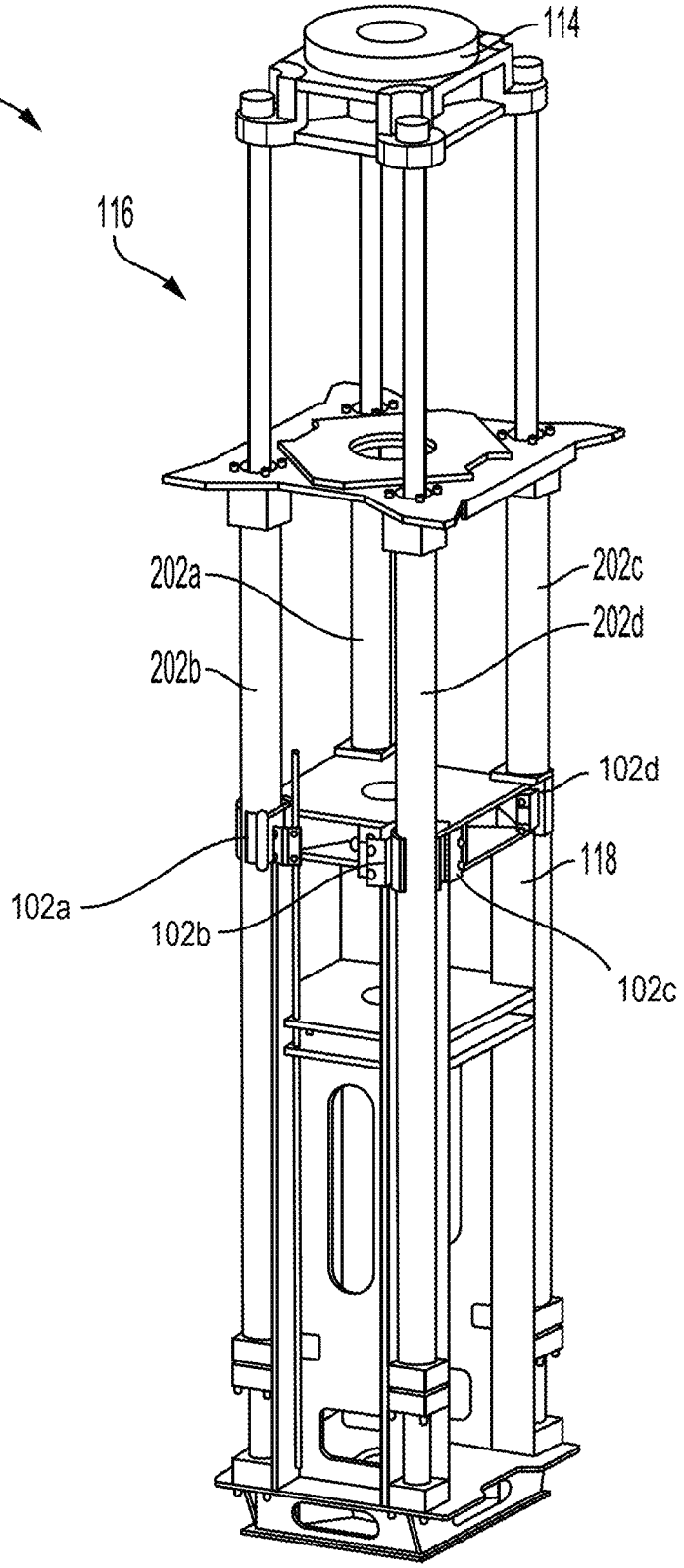
FIG. 2 is a diagram of a subsystem that includes a support device for facilitating torque application in a wellbore according to some aspects of the present disclosure.

FIG. 2 is a diagram of a subsystem 112 that includes a support device 102 for facilitating torque application in a wellbore 104 according to some aspects of the present disclosure. In some examples, the subsystem 112 can be or include a hydraulic workover system that can be positioned in the well system 100 to perform or facilitate one or more wellbore operations in the wellbore 104. As illustrated in FIG. 2, the subsystem 112 can include a set of support devices, the torque device 114, the set of hydraulic cylinders 116, and the support feature 118, though the subsystem 112 can include any additional, alternative, or fewer components for providing functionality for the subsystem 112. The set of support devices can include a first support device 102*a*, a second support device 102*b*, a third support device 102*c*, and a fourth support device 102*d*. The set of hydraulic cylinders 116 can include any suitable number of hydraulic cylinders that can be included in the subsystem 112. For example, and as illustrated in FIG. 2, the set of hydraulic cylinders 116 can include four hydraulic cylinders such as a first hydraulic cylinder 202*a*, a second hydraulic cylinder 202*b*, a third hydraulic cylinder 202*c*, and a fourth hydraulic cylinder 202*d*, though other suitable numbers (e.g., less than four or more than four) of hydraulic cylinders are possible to include in the set of hydraulic cylinders 116.

Although FIG. 2 depicts four support devices, the subsystem 112 may include one support device, two support devices, three support devices, or more than four support devices. In some examples, the subsystem 112 can involve one or more pairs of support devices positioned in contact with a corresponding hydraulic cylinder of the set of hydraulic cylinders 116. The subsystem 112 can include any suitable number of pairs of support devices to provide additional amounts of structural support for the subsystem 112. For example, each hydraulic cylinder of the set of hydraulic cylinders 116 can include or otherwise be connected with a pair of support devices to provide the additional amounts of structural support. In some examples, the additional amounts of structural support can allow a higher amount, compared to systems that do not include the support device 102, of torque to be applied to the subsystem 112.

As illustrated in FIG. 2, the torque device 114 can be positioned at a top 204 of the subsystem 112. In some examples, the top 204 may be on an upstream side, with respect to the wellbore 104, of the subsystem 112. The torque device 114 can receive an applied torque or instructions, which may originate from the surface 108 of the well system 100, to apply a torque for rotating the subsystem 112. The torque device 114 can apply or transfer the torque to the subsystem 112, and the applied torque can be transferred along the set of hydraulic cylinders 116. The set of support devices can dissipate the torque received by the set of hydraulic cylinders 116 to prevent deformation or other damage to the subsystem 112 due to the applied torque. The set of support devices can transfer the applied torque to the support feature 118, which can absorb the torque without allowing damage to the subsystem 112 or any component thereof. In some examples, the support feature 118 can include a set of support features, and each support feature of the set of support features can be located adjacent or otherwise proximate to a corresponding hydraulic cylinder of the set of hydraulic cylinders 116. The set of support devices can be attached, such as permanently or semi-permanently, to a corresponding support feature. Additionally or alternatively, the set of support devices can allow automatic adjustment, automatic alignment, or a combination thereof of the set of hydraulic cylinders 116 in the subsystem 112.

Figure 3:
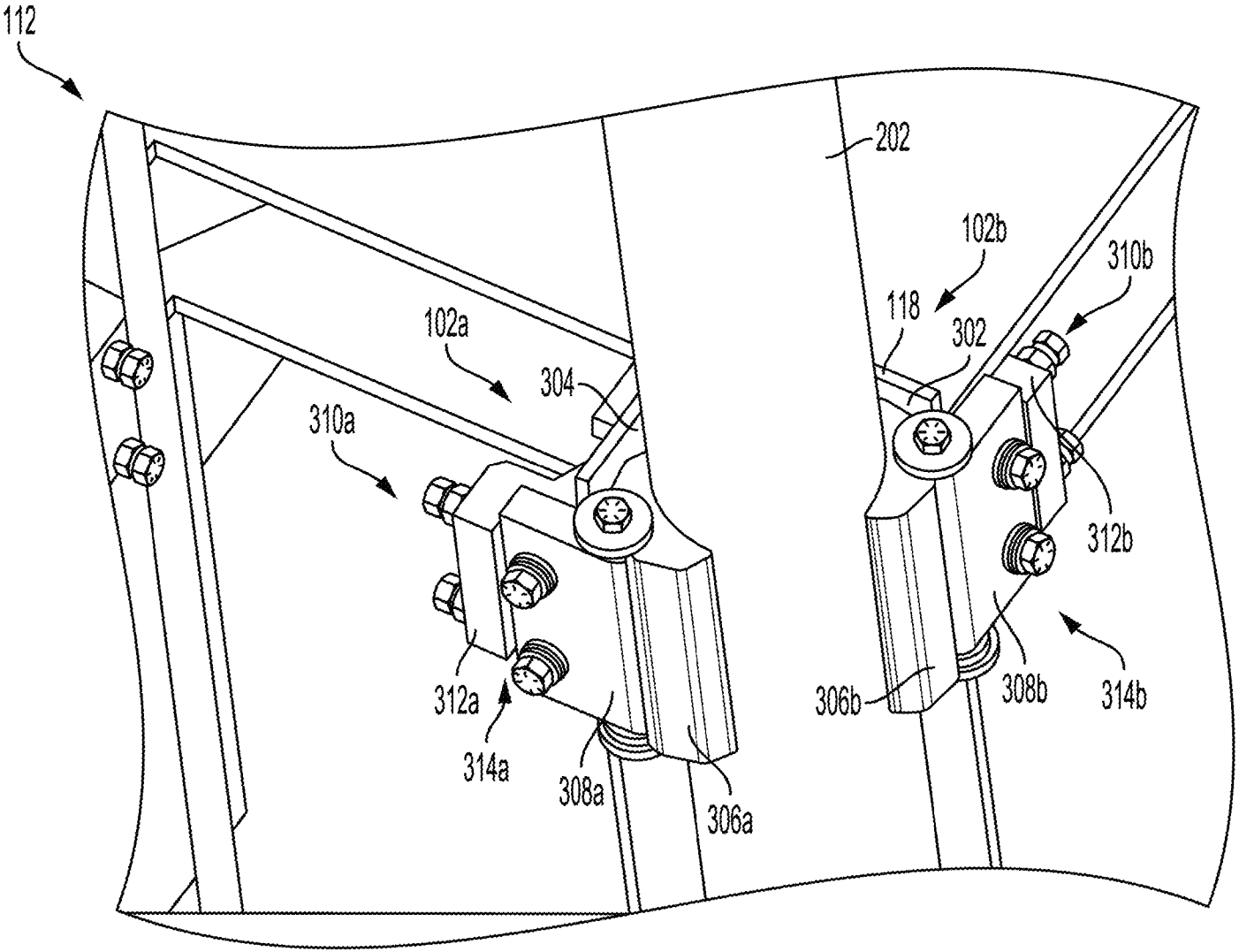
FIG. 3 is a diagram of a support device for facilitating torque application in a wellbore according to some aspects of the present disclosure.

FIG. 3 is a diagram of a support device, such as a first support device 102*a* and a second support device 102*b*, for facilitating torque application in a wellbore 104 according to some aspects of the present disclosure. As illustrated in FIG. 3, the hydraulic cylinder 202 can be coupled with a pair of support devices that includes the first support device 102*a* and the second support device 102*b*. The pair of support devices can be in contact with the hydraulic cylinder 202 that can be included in the set of hydraulic cylinders 116. The pair of support devices can allow for automatic adjustment and automatic alignment of the hydraulic cylinder 202. For example, the pair of support devices can allow the hydraulic cylinder 202 to move with respect to the support feature 118 within a predefined movement range. The predefined movement range may allow a minimum distance to be maintained between the hydraulic cylinder 202 and a first side 302 of the support feature 118 and a second side 304 of the support feature 118.

As illustrated in FIG. 3, a support device, such as the first support device 102*a* or the second support device 102*b*, can include a jaw, a cylindrical hinge, a set of adjustment bolts, and an adapter, though the support device can include any additional, alternative, or fewer components. The first support device 102*a* can include a first jaw 306*a*, a first cylindrical hinge 308*a*, a first set of adjustment bolts 310*a*, and a first adapter 312*a*. Additionally or alternatively, the second support device 102*b* can include a second jaw 306*b*, a second cylindrical hinge 308*b*, a second set of adjustment bolts 310*b*, and a second adapter 312*b*. The first support device 102*a* and the second support device 102*b* can include similar or identical parts, or may have differing parts for supporting the hydraulic cylinder 202. In some examples, the first support device 102*a* can include a first set of securing bolts 314*a*, and the second support device 102*b* can include a second set of securing bolts 314*b*.

Figure 4:
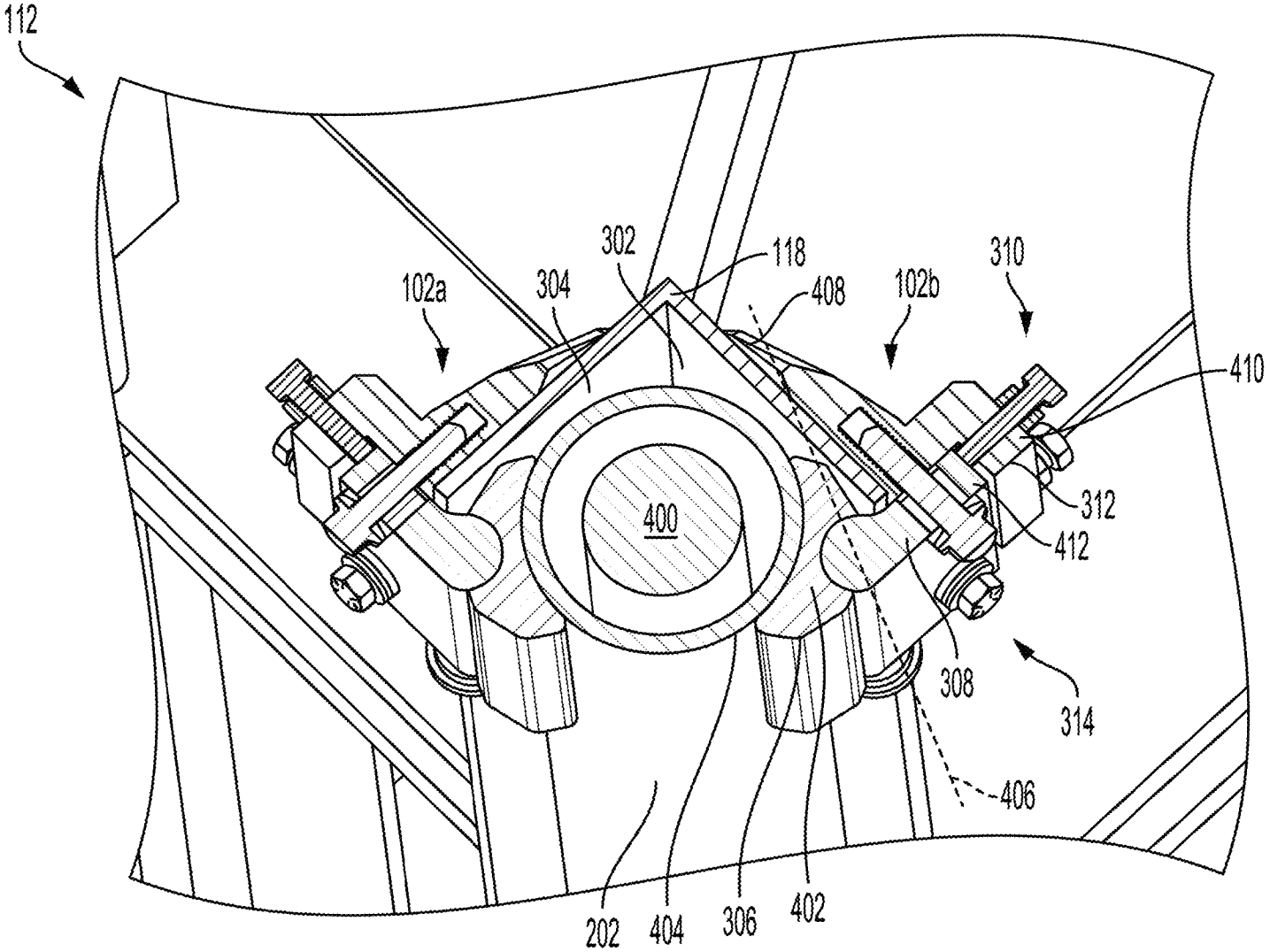
FIG. 4 is a sectional view of a support device for facilitating torque application in a wellbore according to some aspects of the present disclosure.

FIG. 4 is a sectional view of a support device, such as the first support device 102*a* and the second support device 102*b*, for facilitating torque application in a wellbore 104 according to some aspects of the present disclosure. As illustrated in FIG. 4, the second support device 102*b* can be included in a subsystem 112 and can include a jaw 306, a cylindrical hinge 308, a set of adjustment bolts 310, an adapter 312, and a set of securing bolts 314. In some examples, the second support device 102*b* can include any additional, alternative, or fewer components for providing functionality for the second support device 102*b* or the subsystem 112. The second support device 102*b* may be coupled with a hydraulic cylinder 202 that may surround a hydraulic jack 400. In some examples, the second support device 102*b* may have similar or identical components, functionality, or a combination thereof with respect to the first support device 102*a*.

As illustrated in FIG. 4, the jaw 306 can have a curved surface 402 that may conform to a surface 404 of the hydraulic cylinder 202. That is, when the jaw 306 contacts the hydraulic cylinder 202, the curved surface 402 may at least approximately follow the surface 404. In some examples, the jaw 306 may be at least partially rotatable about an axis 406 defined by the cylindrical hinge 308. For example, the jaw 306 can rotate within a predefined rotation range facilitated by the cylindrical hinge 308. Rotation of the jaw 306 can correspond with a movement of the hydraulic cylinder 202. For example, if the hydraulic cylinder 202 moves in a first direction, then the jaw 306 may rotate to follow the hydraulic cylinder 202 to maintain contact between the curved surface 402 and the surface 404.

In some examples, the cylindrical hinge 308 may be coupled with the adapter 312 to position the jaw 306 to maintain contact between the curved surface 402 and the surface 404. The cylindrical hinge 308 may be coupled with the adapter 312 via the set of securing bolts 314 that can extend in a first direction that is approximately perpendicular to a second direction in which the set of adjustment bolts 310 extend in the second support device 102*b*. In some examples, the set of adjustment bolts 310, the set of securing bolts 314, or a combination thereof may include one or more washers, nuts, or the like to facilitate connection of respective bolts to the cylindrical hinge 308, to the adapter 312, etc. The adapter 312 can be coupled with the support feature 118 to permanently, or semi-permanently, affix the second support device 102*b* to the subsystem 112. In some examples, the adapter 312 can be welded, such as via a chamfer 408, to the support feature 118, though bolts or other suitable mechanic means are possible to use for affixing the adapter 312 to the support feature 118.

A position of the jaw 306 with respect to the hydraulic cylinder 202 can be adjusted using the set of adjustment bolts 310. The set of adjustment bolts 310 can extend in the second direction from a first end 410 of the adapter 312 to contact a first end 412 of the cylindrical hinge 308. Rotating each bolt of the set of adjustment bolts 310 can cause the bolt to move closer to the hydraulic cylinder 202 or further from the hydraulic cylinder 202. Additionally or alternatively, the jaw 306 can be moved along with, such as in a same direction, as the bolt when adjusting the bolt, but movement of the jaw 306 may still maintain contact between the curved surface 402 and the surface 404.

Figure 5:
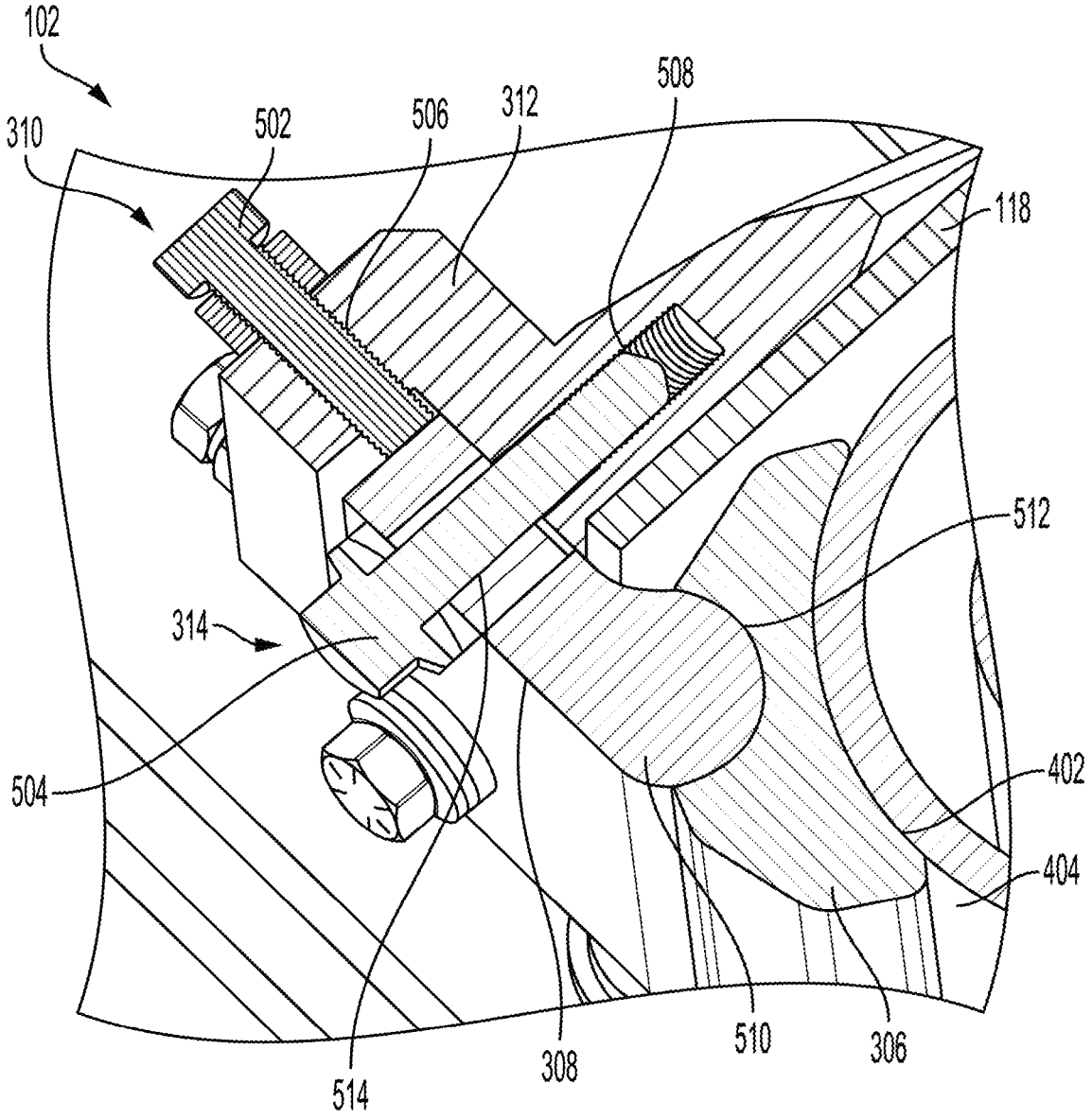
FIG. 5 is a zoomed-in sectional view of a support device for facilitating torque application in a wellbore according to some aspects of the present disclosure.

FIG. 5 is a zoomed-in sectional view of a support device 102 for facilitating torque application in a wellbore 104 according to some aspects of the present disclosure. As illustrated in FIG. 5, the support device 102 can include the jaw 306, the cylindrical hinge 308, the set of adjustment bolts 310, the adapter 312, and the set of securing bolts 314. In some examples, the support device 102 can include any additional, alternative, or fewer components for providing functionality for the support device 102 in the subsystem 112. The jaw 306 can include the curved surface 402 that can conform to the surface 404, and the jaw 306 can be rotated about the cylindrical hinge 308 or any axis defined thereby to maintain contact between the curved surface 402 and the surface 404. The maintained contact between the curved surface 402 and the surface 404, while allowing the hydraulic cylinder 202 to move in a predefined movement range, can allow automatic alignment and automatic adjustment of the hydraulic cylinder 202 during operation of the subsystem 112.

As illustrated in FIG. 5, the set of adjustment bolts 310 can include a first adjustment bolt 502, and the set of securing bolts 314 can include a first securing bolt 504. The first adjustment bolt 502 can be similar or identical to, or different from, other bolts included in the set of adjustment bolts 310, and the first securing bolt 504 can be similar or identical to, or different from, other bolts included in the set of securing bolts 314. The first adjustment bolt 502 may be at least partially threaded and can extend into an adjustment slot 506 that may be or include an at least partially threaded slot that is sized to receive the first adjustment bolt 502. The adjustment slot 506 may be included in a set of adjustment slots, each of which can be sized to receive a different adjustment bolt of the set of adjustment bolts 310. Additionally or alternatively, the first securing bolt 504 may be at least partially threaded and can extend into a securing slot 508 that may be or include an at least partially threaded slot that is sized to receive the first securing bolt 504. The securing slot 508 may be included in a set of securing slots, each of which can be sized to receive a different securing bolt of the set of securing bolts 314.

In some examples, the adjustment slot 506, or the set of adjustment slots, can be located opposite, with respect to the cylindrical hinge 308, a convex-shaped attachment feature 510 of the cylindrical hinge 308. The convex-shaped attachment feature 510 can be sized, shaped, or a combination thereof to fit into an attachment slot 512 of the jaw 306. The attachment slot 512 may be located opposite the curved surface 402 with respect to the jaw. Additionally or alternatively, the attachment slot 512 can have a concave shape, while the convex-shaped attachment feature 510 can have an approximately convex shape. The convex-shaped attachment feature 510 can be positioned in the attachment slot 512 to facilitate a hinge-like motion of the jaw 306 with respect to the cylindrical hinge 308.

In some examples, the adapter 312 can be arranged to facilitate a connection between the cylindrical hinge 308 and the support feature 118, or support structure, of the subsystem 112. For example, the adapter 312 can be welded to the support feature 118 while the set of securing bolts 314 can affix the cylindrical hinge 308 to the adapter 312. The set of securing bolts 314 can extend through the cylindrical hinge 308 and into the set of securing slots. For example, the first securing bolt 504 can extend through a slot 514 of the cylindrical hinge 308 and into the securing slot 508 for securing at least a portion of the cylindrical hinge 308 to the adapter 312. In some examples, the set of securing slots, and the slot 514, can be approximately perpendicular to the set of adjustment slots to facilitate an adjustment of a position of the jaw 306 with respect to the hydraulic cylinder 202.

Figure 6:
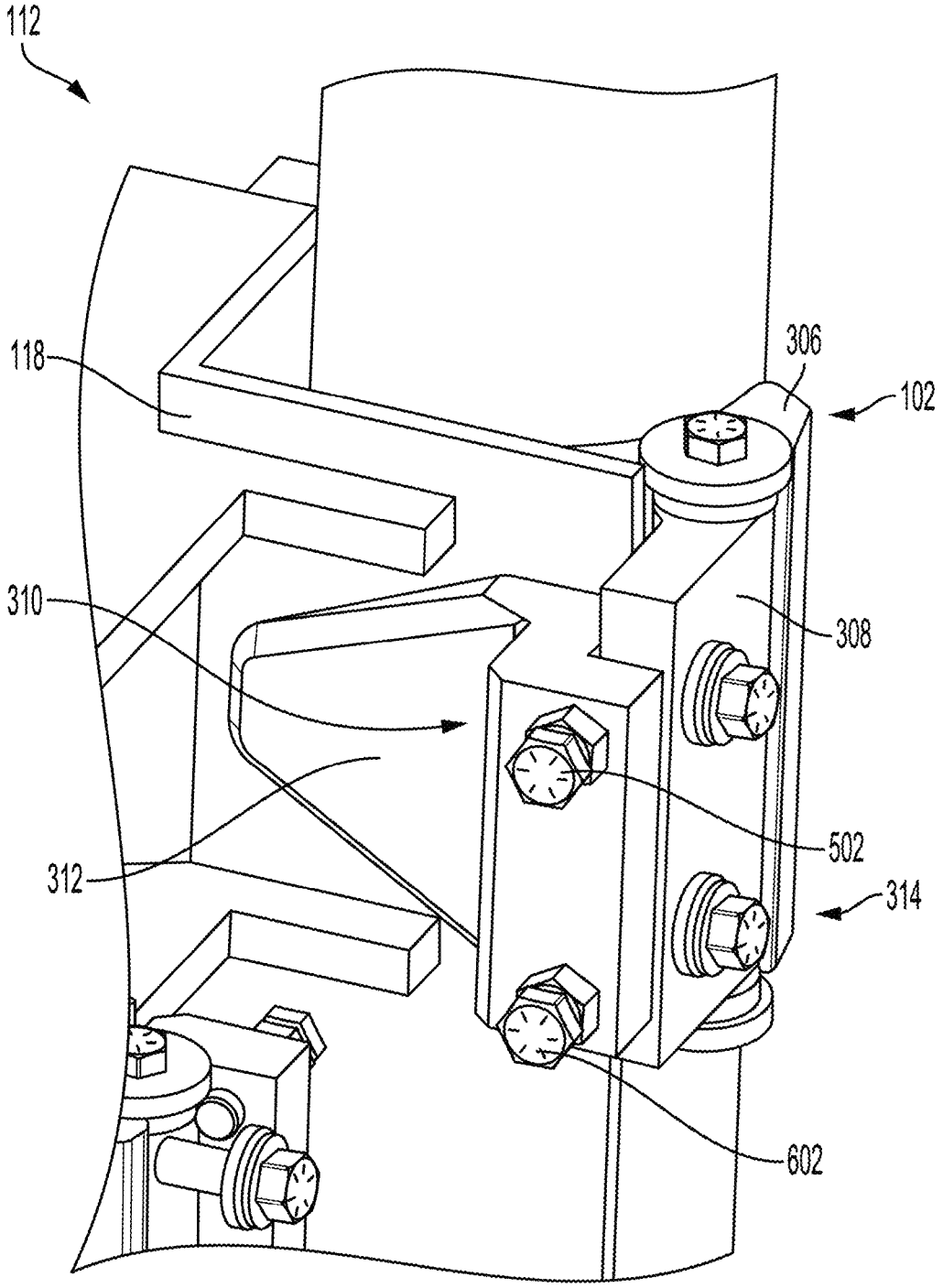
FIG. 6 is a perspective view of an adapter for a support device for facilitating torque application in a wellbore according to some aspects of the present disclosure.

FIG. 6 is a perspective view of an adapter 312 for a support device 102 for facilitating torque application in a wellbore 104 according to some aspects of the present disclosure. As illustrated in FIG. 6, the support device 102 can include the jaw 306, the cylindrical hinge 308, the set of adjustment bolts 310, the adapter 312, and the set of securing bolts 314. In some examples, the support device 102 can include any additional, alternative, or fewer components for providing functionality for the support device 102 in the subsystem 112. The adapter 312 can be used to attach the support device 102 to the hydraulic cylinder 202 of the subsystem 112 to facilitate torque application in the wellbore 104. For example, the adapter 312 can be welded, or attached via one or more bolts or other suitable mechanical or chemical means, to the support feature 118, which may be or include an existing support structure in the subsystem 112.

As illustrated in FIG. 6, the set of adjustment bolts 310 can include the first adjustment bolt 502 and a second adjustment bolt 602, though the set of adjustment bolts 310 can include any other suitable number, such as less than two or more than two, adjustment bolts. The set of adjustment bolts 310 can extend through the adapter 312 to contact the cylindrical hinge 308 for adjusting a position of the cylindrical hinge 308 relative to the hydraulic cylinder 202. Adjusting the position of the cylindrical hinge 308 can also adjust a position of the jaw 306, though the jaw 306 may be able to rotate to maintain contact between the curved surface 402 and the surface 404.

Figure 7:
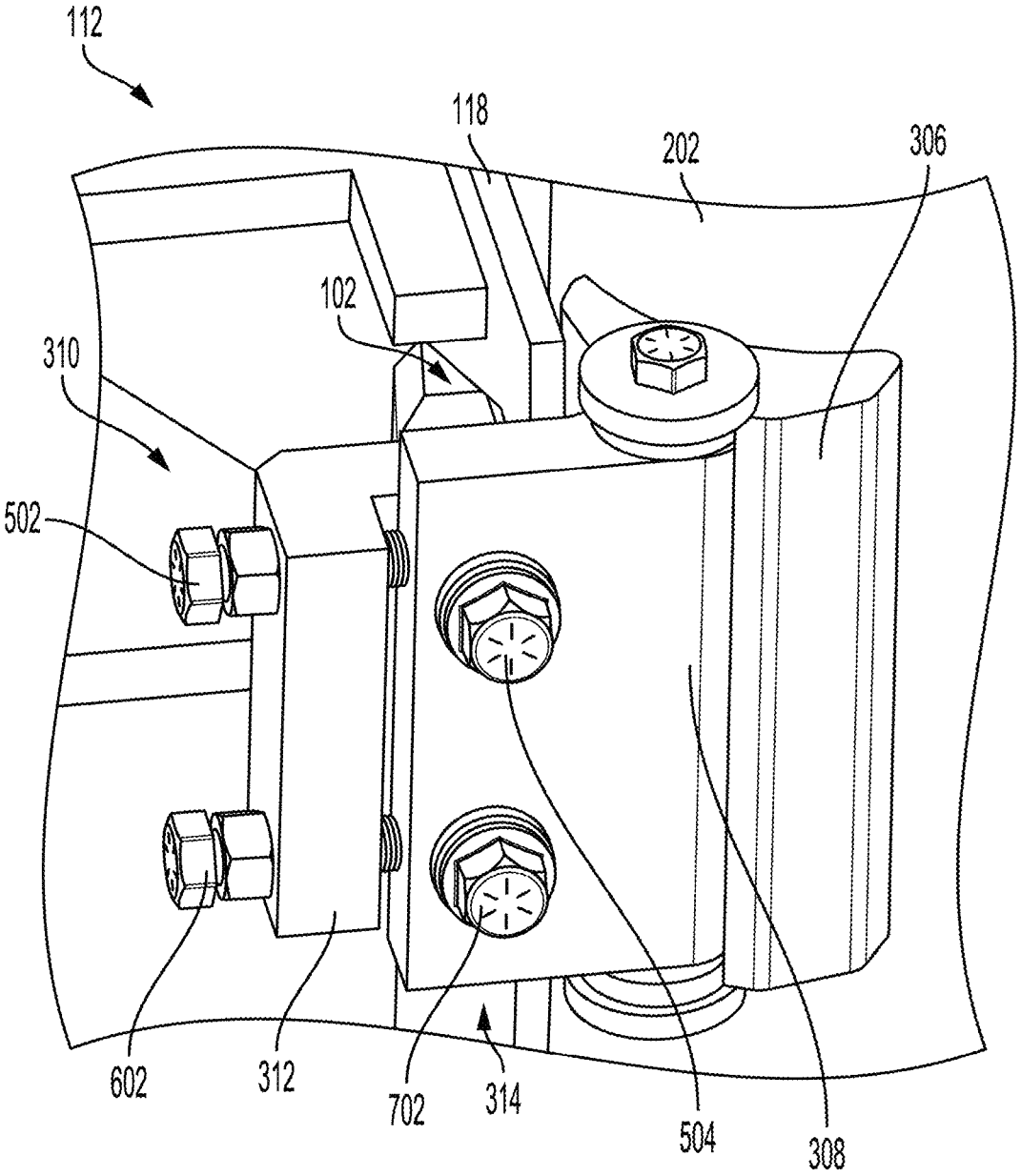
FIG. 7 is a perspective view of a cylindrical hinge of a support device for facilitating torque application in a wellbore according to some aspects of the present disclosure according to some aspects of the present disclosure.

FIG. 7 is a perspective view of a cylindrical hinge 308 of a support device 102 for facilitating torque application in a wellbore 104 according to some aspects of the present disclosure according to some aspects of the present disclosure. As illustrated in FIG. 7, the support device 102 can include the jaw 306, the cylindrical hinge 308, the set of adjustment bolts 310, the adapter 312, and the set of securing bolts 314. In some examples, the support device 102 can include any additional, alternative, or fewer components for providing functionality for the support device 102 in the subsystem 112. The cylindrical hinge 308 can be attached to the jaw 306 to facilitate a hinge-like motion of the jaw 306 about the cylindrical hinge 308 for maintaining contact between the jaw 306 and the hydraulic cylinder 202 via the curved surface 402 and the surface 404. For example, the convex-shaped attachment feature 510 of the cylindrical hinge 308 can be positioned within the attachment slot 512 of the jaw 306 to couple the jaw 306 with the cylindrical hinge 308.

As illustrated in FIG. 7, the cylindrical hinge 308 can include, or facilitate attachment to the support device 102, the set of securing bolts 314. The set of securing bolts 314 can include a first securing bolt 504 and a second securing bolt 702, though the set of securing bolts 314 can include any other suitable number, such as less than two or more than two, of securing bolts for securing the cylindrical hinge 308 to support device 102 or the subsystem 112 via the adapter 312. In some examples, the set of adjusting bolts 310 can be adjusted to set a position of the cylindrical hinge 308 and the jaw 306 relative to the hydraulic cylinder 202 and the adapter 312, respectively, and then the set of securing bolts 314 can be positioned through the cylindrical hinge 308 and into the set of securing slots to retain the position of the jaw 306 and the cylindrical hinge 308. Once the set of securing bolts 314 are positioned into the set of securing slots, the position of the jaw 306 and the cylindrical hinge 308 may not be able to be adjusted, but the jaw 306 may be able to at least partially rotate about the cylindrical hinge 308 to facilitate self-adjustment and self-alignment of the hydraulic cylinder 202 while in operation.

Figure 8:
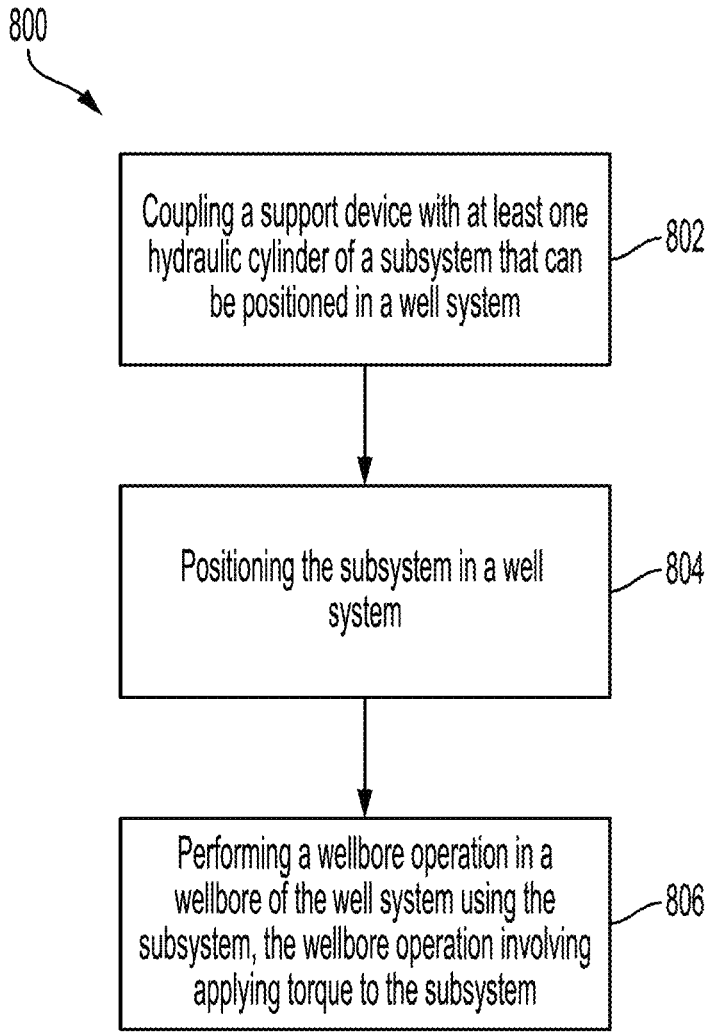
FIG. 8 is a flowchart of a process for using a support device to facilitate torque application on a hydraulic workover unit in a wellbore according to some aspects of the present disclosure.

FIG. 8 is a flowchart of a process 800 for using a support device 102 to facilitate torque application on a hydraulic workover unit, such as the subsystem 112, in a wellbore 104 according to some aspects of the present disclosure. At block 802, the support device 102 is coupled with at least one hydraulic cylinder, such as the hydraulic cylinder 202, of a set of hydraulic cylinders 116. In some examples, the support device 102 and the set of hydraulic cylinders 116 can be in one-to-one correspondence such that at least one support device, such as the support device 102, can be applied to each hydraulic cylinder of the set of hydraulic cylinders 116. In other examples, the support device 102 and the set of hydraulic cylinders 116 can be in two-to-one correspondence such that a different pair of support devices can be applied to each hydraulic cylinder of the set of hydraulic cylinders 116. The set of hydraulic cylinders 116 can be positioned in a subsystem 112 such as a hydraulic workover unit. The support device 102 can include a jaw 306 coupled with the at least one hydraulic cylinder.

At block 804, the subsystem 112 can be positioned in a well system 100. The subsystem 112 can be positioned in the well system 100, such as at a surface 108 of the wellbore 104 or other location, using any suitable means for positioning the subsystem 112 in the well system 100. The support device 102 may be affixed to, or otherwise within, the subsystem 112 prior to positioning the subsystem 112 in the well system 100. In some examples, the subsystem 112 may be rotated while in the well system 100, and the support device 102 may provide structural support for the subsystem 112 while the subsystem 112 is rotated or is otherwise in operation. In some examples, the wellbore operation can involve positioning a pipe or a pipe string through the subsystem 112 to allow the pipe or pipe string to perform a wellbore operation in the wellbore 104 based at least in part on the subsystem 112 rotating according to an applied torque.

At block 806, a wellbore operation is performed in the wellbore 104 using the subsystem 112. For example, a drilling operation can be performed, or other suitable wellbore operation that involves rotating the subsystem 112 can be performed. In some examples, the wellbore operation can involve applying torque to the subsystem 112, which may be or include a hydraulic workover unit. The applied torque can cause the subsystem 112 to rotate within the well system 100. The jaw 306 of the support device 102 can contact a hydraulic cylinder of the subsystem 112 and can limit movement of the hydraulic cylinder to a predefined movement range. Limiting the movement of the hydraulic cylinder, while still allowing movement within the predefined movement range, can allow the support device 102 to provide automatic alignment of the hydraulic cylinder, automatic adjustment of a position of the hydraulic cylinder, or a combination thereof during the wellbore operation.

In some aspects, systems and methods for a support device for a hydraulic workover unit in a well system are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a subsystem comprising a hydraulic workover unit having one or more hydraulic cylinders, the subsystem positionable on a well for facilitating an operation in a wellbore of the well; and a support device couplable with the subsystem to facilitate torque application of the subsystem during the operation, the support device comprising a jaw couplable with the hydraulic cylinder, the jaw arranged with respect to the one or more hydraulic cylinders to facilitate automatic alignment and automatic adjustment of the one or more hydraulic cylinders.

Example 2 is the system of example 1, wherein the jaw is couplable with a first side of the one or more hydraulic cylinders, wherein the support device further comprises a second jaw, and wherein the second jaw is couplable with a second side of the one or more hydraulic cylinders opposite the first side to control motion of the one or more hydraulic cylinders in two or more directions.

Example 3 is the system of example 1, wherein a surface of the jaw has a shape that conforms to a surface of the one or more hydraulic cylinders, wherein the jaw further comprises an attachment slot that has a concave shape, wherein the support device further comprises a cylindrical hinge that comprises a convex-shaped attachment feature, and wherein the convex-shaped attachment feature is positionable in the attachment slot to connect the jaw to the cylindrical hinge to facilitate a hinge motion of the jaw.

Example 4 is the system of example 3, wherein the support device further comprises a plurality of adjustment bolts positionable in a plurality of adjustment slots located opposite the convex-shaped attachment feature with respect to the cylindrical hinge, and wherein a position of the jaw relative to the one or more hydraulic cylinders is adjustable using the plurality of adjustment bolts.

Example 5 is the system of example 3, wherein the support device further comprises an adapter arranged to facilitate a connection between the cylindrical hinge and a support structure of the subsystem, and wherein the adapter is weldable to the support structure.

Example 6 is the system of example 5, wherein the support device further comprises a plurality of securing bolts positionable in a plurality of securing slots that extend through the cylindrical hinge and into the adapter, and wherein the plurality of securing slots are oriented perpendicularly with respect to a plurality of adjustment bolts positionable in the cylindrical hinge to facilitate adjustment of a position of the jaw.

Example 7 is the system of example 1, wherein the one or more hydraulic cylinders include four hydraulic cylinders that extend from a first end of the subsystem to a second end of the subsystem opposite the first end, wherein the system comprises a plurality of support devices that includes at least eight support devices, wherein the plurality of support devices comprises four different pairs of support devices, wherein each pair of support devices is coupled with a different hydraulic cylinder of the four hydraulic cylinders, and wherein each support device included in each pair of support devices of the four different pairs of support devices comprises: a jaw positioned to be in contact with a corresponding hydraulic cylinder of the four hydraulic cylinder, the jaw comprising: a curved surface that conforms to a surface of the corresponding hydraulic cylinder; and an attachment slot that has a concave shape; a cylindrical hinge that comprises a convex-shaped attachment feature positioned in the attachment slot of the jaw to facilitate rotation of the jaw about the cylindrical hinge; and an adapter that is welded to a support structure of the hydraulic workover unit, wherein the cylindrical hinge is coupled with the adapter to allow adjustment of: a relative position of the cylindrical hinge with respect to the corresponding hydraulic cylinder; and a relative position of the jaw with respect to the support structure.

Example 8 is a system comprising: a hydraulic workover unit comprising a plurality of hydraulic cylinders, the hydraulic workover unit positionable on a well for facilitating an operation in a wellbore of the well; and a support device couplable with the hydraulic workover unit to facilitate torque application of the hydraulic workover unit during the operation, the support device comprising a jaw couplable with at least one hydraulic cylinder of the plurality of hydraulic cylinders, the jaw arranged with respect to the at least one hydraulic cylinder to facilitate automatic alignment and automatic adjustment of the at least one hydraulic cylinder.

Example 9 is the system of example 8, wherein the jaw is couplable with a first side of the at least one hydraulic cylinder, wherein the support device further comprises a second jaw, and wherein the second jaw is couplable with a second side of the at least one hydraulic cylinder opposite the first side to control motion of the at least one hydraulic cylinder in two or more directions.

Example 10 is the system of example 8, wherein a surface of the jaw has a shape that conforms to a surface of the at least one hydraulic cylinder, wherein the jaw further comprises an attachment slot that has a concave shape, wherein the support device further comprises a cylindrical hinge that comprises a convex-shaped attachment feature, and wherein the convex-shaped attachment feature is positionable in the attachment slot to connect the jaw to the cylindrical hinge to facilitate a hinge motion of the jaw.

Example 11 is the system of example 10, wherein the support device further comprises a plurality of adjustment bolts positionable in a plurality of adjustment slots located opposite the convex-shaped attachment feature with respect to the cylindrical hinge, and wherein a position of the jaw relative to the at least one hydraulic cylinder is adjustable using the plurality of adjustment bolts.

Example 12 is the system of example 10, wherein the support device further comprises an adapter arranged to facilitate a connection between the cylindrical hinge and a support structure of the hydraulic workover unit, and wherein the adapter is weldable to the support structure.

Example 13 is the system of example 12, wherein the support device further comprises a plurality of securing bolts positionable in a plurality of securing slots that extend through the cylindrical hinge and into the adapter, and wherein the plurality of securing slots are oriented perpendicularly with respect to a plurality of adjustment bolts positionable in the cylindrical hinge to facilitate adjustment of a position of the jaw.

Example 14 is the system of example 8, wherein the plurality of hydraulic cylinders includes four hydraulic cylinders that extend from a first end of the hydraulic workover unit to a second end of the hydraulic workover unit opposite the first end, wherein the system comprises a plurality of support devices that includes at least eight support devices, wherein the plurality of support devices comprises four different pairs of support devices, wherein each pair of support devices is coupled with a different hydraulic cylinder of the four hydraulic cylinders, and wherein each support device included in each pair of support devices of the four different pairs of support devices comprises: a jaw positioned to be in contact with a corresponding hydraulic cylinder of the four hydraulic cylinder, the jaw comprising: a curved surface that conforms to a surface of the corresponding hydraulic cylinder; and an attachment slot that has a concave shape; a cylindrical hinge that comprises a convex-shaped attachment feature positioned in the attachment slot of the jaw to facilitate rotation of the jaw about the cylindrical hinge; and an adapter that is welded to a support structure of the hydraulic workover unit, wherein the cylindrical hinge is coupled with the adapter to allow adjustment of: a relative position of the cylindrical hinge with respect to the corresponding hydraulic cylinder; and a relative position of the jaw with respect to the support structure.

Example 15 is a method comprising: coupling a support device with at least one hydraulic cylinder of a plurality of hydraulic cylinders, the plurality of hydraulic cylinders positioned in a hydraulic workover unit, the support device comprising a jaw coupled with the at least one hydraulic cylinder; positioning the hydraulic workover unit and the support device on a well system that includes a wellbore; and performing a wellbore operation in the wellbore using the hydraulic workover unit, the wellbore operation involving applying torque to the hydraulic workover unit, and the jaw arranged to facilitate automatic alignment and automatic adjustment of the at least one hydraulic cylinder during the wellbore operation.

Example 16 is the method of example 15, wherein the jaw is coupled with a first side of the at least one hydraulic cylinder, wherein a second jaw of the support device is coupled with a second side of the at least one hydraulic cylinder opposite the first side to control motion of the at least one hydraulic cylinder in two or more directions during the wellbore operation.

Example 17 is the method of example 15, wherein a surface of the jaw has a shape that conforms to a surface of the at least one hydraulic cylinder, wherein the jaw further comprises an attachment slot that has a concave shape, wherein the support device further comprises a cylindrical hinge that comprises a convex-shaped attachment feature, and wherein coupling the support device with the at least one hydraulic cylinder comprises positioning the convex-shaped attachment feature in the attachment slot to connect the jaw to the cylindrical hinge to facilitate a hinge motion of the jaw.

Example 18 is the method of example 17, wherein the support device further comprises a plurality of adjustment bolts positioned in a plurality of adjustment slots located opposite the convex-shaped attachment feature with respect to the cylindrical hinge, and wherein coupling the support device with the at least one hydraulic cylinder comprises adjusting a position of the jaw relative to the at least one hydraulic cylinder using the plurality of adjustment bolts.

Example 19 is the method of example 17, wherein the support device further comprises an adapter arranged to facilitate a connection between the cylindrical hinge and a support structure of the hydraulic workover unit, wherein coupling the support device with the at least one hydraulic cylinder comprises welding the adapter to the support structure, wherein the support device further comprises a plurality of securing bolts positioned in a plurality of securing slots that extend through the cylindrical hinge and into the adapter, and wherein the plurality of securing slots are oriented perpendicularly with respect to a plurality of adjustment bolts positioned in the cylindrical hinge to facilitate adjustment of a position of the jaw.

Example 20 is the method of example 15, wherein the plurality of hydraulic cylinders consists of four hydraulic cylinders that extend from a first end of the hydraulic workover unit to a second end of the hydraulic workover unit opposite the first end, wherein the hydraulic workover unit comprises a plurality of support devices that includes at least eight support devices, wherein the plurality of support devices comprises four different pairs of support devices, wherein each pair of support devices is coupled with a different hydraulic cylinder of the four hydraulic cylinders, and wherein each support device included in each pair of support devices of the four different pairs of support devices comprises: a jaw positioned to be in contact with a corresponding hydraulic cylinder of the four hydraulic cylinder, the jaw comprising: a curved surface that conforms to a surface of the corresponding hydraulic cylinder; and an attachment slot that has a concave shape; a cylindrical hinge that comprises a convex-shaped attachment feature positioned in the attachment slot of the jaw to facilitate rotation of the jaw about the cylindrical hinge; and an adapter that is welded to a support structure of the hydraulic workover unit, wherein the cylindrical hinge is coupled with the adapter to allow adjustment of: a relative position of the cylindrical hinge with respect to the corresponding hydraulic cylinder; and a relative position of the jaw with respect to the support structure.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a subsystem comprising a hydraulic workover unit having one or more hydraulic cylinders, the subsystem positionable on a well for facilitating an operation in a wellbore of the well; and a support device couplable with the subsystem to facilitate torque application of the subsystem during the operation, the support device comprising a jaw couplable with the hydraulic cylinder, the jaw arranged with respect to the one or more hydraulic cylinders to facilitate automatic alignment and automatic adjustment of the one or more hydraulic cylinders.

2. The system of claim 1, wherein the jaw is couplable with a first side of the one or more hydraulic cylinders, wherein the support device further comprises a second jaw, and wherein the second jaw is couplable with a second side of the one or more hydraulic cylinders opposite the first side to control motion of the one or more hydraulic cylinders in two or more directions.

3. The system of claim 1, wherein a surface of the jaw has a shape that conforms to a surface of the one or more hydraulic cylinders, wherein the jaw further comprises an attachment slot that has a concave shape, wherein the support device further comprises a cylindrical hinge that comprises a convex-shaped attachment feature, and wherein the convex-shaped attachment feature is positionable in the attachment slot to connect the jaw to the cylindrical hinge to facilitate a hinge motion of the jaw.

4. The system of claim 3, wherein the support device further comprises a plurality of adjustment bolts positionable in a plurality of adjustment slots located opposite the convex-shaped attachment feature with respect to the cylindrical hinge, and wherein a position of the jaw relative to the one or more hydraulic cylinders is adjustable using the plurality of adjustment bolts.

5. The system of claim 3, wherein the support device further comprises an adapter arranged to facilitate a connection between the cylindrical hinge and a support structure of the subsystem, and wherein the adapter is weldable to the support structure.

6. The system of claim 5, wherein the support device further comprises a plurality of securing bolts positionable in a plurality of securing slots that extend through the cylindrical hinge and into the adapter, and wherein the plurality of securing slots are oriented perpendicularly with respect to a plurality of adjustment bolts positionable in the cylindrical hinge to facilitate adjustment of a position of the jaw.

7. The system of claim 1, wherein the one or more hydraulic cylinders include four hydraulic cylinders that extend from a first end of the subsystem to a second end of the subsystem opposite the first end, wherein the system comprises a plurality of support devices that includes at least eight support devices, wherein the plurality of support devices comprises four different pairs of support devices, wherein each pair of support devices is coupled with a different hydraulic cylinder of the four hydraulic cylinders, and wherein each support device included in each pair of support devices of the four different pairs of support devices comprises:

a jaw positioned to be in contact with a corresponding hydraulic cylinder of the four hydraulic cylinder, the jaw comprising:

a curved surface that conforms to a surface of the corresponding hydraulic cylinder; and an attachment slot that has a concave shape;

a cylindrical hinge that comprises a convex-shaped attachment feature positioned in the attachment slot of the jaw to facilitate rotation of the jaw about the cylindrical hinge; and an adapter that is welded to a support structure of the hydraulic workover unit, wherein the cylindrical hinge is coupled with the adapter to allow adjustment of:

a relative position of the cylindrical hinge with respect to the corresponding hydraulic cylinder; and a relative position of the jaw with respect to the support structure.

8. A system comprising:

a hydraulic workover unit comprising a plurality of hydraulic cylinders, the hydraulic workover unit positionable on a well for facilitating an operation in a wellbore of the well; and a support device couplable with the hydraulic workover unit to facilitate torque application of the hydraulic workover unit during the operation, the support device comprising a jaw couplable with at least one hydraulic cylinder of the plurality of hydraulic cylinders, the jaw arranged with respect to the at least one hydraulic cylinder to facilitate automatic alignment and automatic adjustment of the at least one hydraulic cylinder.

9. The system of claim 8, wherein the jaw is couplable with a first side of the at least one hydraulic cylinder, wherein the support device further comprises a second jaw, and wherein the second jaw is couplable with a second side of the at least one hydraulic cylinder opposite the first side to control motion of the at least one hydraulic cylinder in two or more directions.

10. The system of claim 8, wherein a surface of the jaw has a shape that conforms to a surface of the at least one hydraulic cylinder, wherein the jaw further comprises an attachment slot that has a concave shape, wherein the support device further comprises a cylindrical hinge that comprises a convex-shaped attachment feature, and wherein the convex-shaped attachment feature is positionable in the attachment slot to connect the jaw to the cylindrical hinge to facilitate a hinge motion of the jaw.

11. The system of claim 10, wherein the support device further comprises a plurality of adjustment bolts positionable in a plurality of adjustment slots located opposite the convex-shaped attachment feature with respect to the cylindrical hinge, and wherein a position of the jaw relative to the at least one hydraulic cylinder is adjustable using the plurality of adjustment bolts.

12. The system of claim 10, wherein the support device further comprises an adapter arranged to facilitate a connection between the cylindrical hinge and a support structure of the hydraulic workover unit, and wherein the adapter is weldable to the support structure.

13. The system of claim 12, wherein the support device further comprises a plurality of securing bolts positionable in a plurality of securing slots that extend through the cylindrical hinge and into the adapter, and wherein the plurality of securing slots are oriented perpendicularly with respect to a plurality of adjustment bolts positionable in the cylindrical hinge to facilitate adjustment of a position of the jaw.

14. The system of claim 8, wherein the plurality of hydraulic cylinders includes four hydraulic cylinders that extend from a first end of the hydraulic workover unit to a second end of the hydraulic workover unit opposite the first end, wherein the system comprises a plurality of support devices that includes at least eight support devices, wherein the plurality of support devices comprises four different pairs of support devices, wherein each pair of support devices is coupled with a different hydraulic cylinder of the four hydraulic cylinders, and wherein each support device included in each pair of support devices of the four different pairs of support devices comprises:

a jaw positioned to be in contact with a corresponding hydraulic cylinder of the four hydraulic cylinder, the jaw comprising:

a curved surface that conforms to a surface of the corresponding hydraulic cylinder; and an attachment slot that has a concave shape;

a cylindrical hinge that comprises a convex-shaped attachment feature positioned in the attachment slot of the jaw to facilitate rotation of the jaw about the cylindrical hinge; and an adapter that is welded to a support structure of the hydraulic workover unit, wherein the cylindrical hinge is coupled with the adapter to allow adjustment of:

a relative position of the cylindrical hinge with respect to the corresponding hydraulic cylinder; and a relative position of the jaw with respect to the support structure.

15. A method comprising:

coupling a support device with at least one hydraulic cylinder of a plurality of hydraulic cylinders, the plurality of hydraulic cylinders positioned in a hydraulic workover unit, the support device comprising a jaw coupled with the at least one hydraulic cylinder;

positioning the hydraulic workover unit and the support device on a well system that includes a wellbore; and performing a wellbore operation in the wellbore using the hydraulic workover unit, the wellbore operation involving applying torque to the hydraulic workover unit, and the jaw arranged to facilitate automatic alignment and automatic adjustment of the at least one hydraulic cylinder during the wellbore operation.

16. The method of claim 15, wherein the jaw is coupled with a first side of the at least one hydraulic cylinder, wherein a second jaw of the support device is coupled with a second side of the at least one hydraulic cylinder opposite the first side to control motion of the at least one hydraulic cylinder in two or more directions during the wellbore operation.

17. The method of claim 15, wherein a surface of the jaw has a shape that conforms to a surface of the at least one hydraulic cylinder, wherein the jaw further comprises an attachment slot that has a concave shape, wherein the support device further comprises a cylindrical hinge that comprises a convex-shaped attachment feature, and wherein coupling the support device with the at least one hydraulic cylinder comprises positioning the convex-shaped attachment feature in the attachment slot to connect the jaw to the cylindrical hinge to facilitate a hinge motion of the jaw.

18. The method of claim 17, wherein the support device further comprises a plurality of adjustment bolts positioned in a plurality of adjustment slots located opposite the convex-shaped attachment feature with respect to the cylindrical hinge, and wherein coupling the support device with the at least one hydraulic cylinder comprises adjusting a position of the jaw relative to the at least one hydraulic cylinder using the plurality of adjustment bolts.

19. The method of claim 17, wherein the support device further comprises an adapter arranged to facilitate a connection between the cylindrical hinge and a support structure of the hydraulic workover unit, wherein coupling the support device with the at least one hydraulic cylinder comprises welding the adapter to the support structure, wherein the support device further comprises a plurality of securing bolts positioned in a plurality of securing slots that extend through the cylindrical hinge and into the adapter, and wherein the plurality of securing slots are oriented perpendicularly with respect to a plurality of adjustment bolts positioned in the cylindrical hinge to facilitate adjustment of a position of the jaw.

20. The method of claim 15, wherein the plurality of hydraulic cylinders consists of four hydraulic cylinders that extend from a first end of the hydraulic workover unit to a second end of the hydraulic workover unit opposite the first end, wherein the hydraulic workover unit comprises a plurality of support devices that includes at least eight support devices, wherein the plurality of support devices comprises four different pairs of support devices, wherein each pair of support devices is coupled with a different hydraulic cylinder of the four hydraulic cylinders, and wherein each support device included in each pair of support devices of the four different pairs of support devices comprises:

- a jaw positioned to be in contact with a corresponding hydraulic cylinder of the four hydraulic cylinder, the jaw comprising:
  - a curved surface that conforms to a surface of the corresponding hydraulic cylinder; and
  - an attachment slot that has a concave shape;
- a cylindrical hinge that comprises a convex-shaped attachment feature positioned in the attachment slot of the jaw to facilitate rotation of the jaw about the cylindrical hinge; and
- an adapter that is welded to a support structure of the hydraulic workover unit, wherein the cylindrical hinge is coupled with the adapter to allow adjustment of:
  - a relative position of the cylindrical hinge with respect to the corresponding hydraulic cylinder; and
  - a relative position of the jaw with respect to the support structure.

* * * * *